US005091953A

United States Patent [19]

Tretter

[11] Patent Number: 5,091,953

[45] Date of Patent: Feb. 25, 1992

[54] REPETITIVE PHENOMENA CANCELLATION ARRANGEMENT WITH MULTIPLE SENSORS AND ACTUATORS

[75] Inventor: Steven A. Tretter, Silver Spring, Md.

[73] Assignee: University of Maryland at College Park, College Park, Md.

[21] Appl. No.: 479,466

[22] Filed: Feb. 13, 1990

[51] Int. Cl.[5] ..... G10K 11/16

[52] U.S. Cl. ..... 351/71

[58] Field of Search ..... 381/71

[56] References Cited

U.S. PATENT DOCUMENTS 4,878,188 10/1989 Ziegler, Jr. ..... 364/724.01

FOREIGN PATENT DOCUMENTS

WO8802912 4/1988 PCT Int'l Appl. .

*Primary Examiner*—Forester W. Isen
*Assistant Examiner*—Sylvia Chen
*Attorney, Agent, or Firm*—Oblon, Spivak, McClelland, Maier & Neustadt

[57] ABSTRACT

Repetitive phenomena cancelling controller arrangement for cancelling unwanted repetitive phenomena comprising known fundamental frequencies. The known frequencies are determined and an electrical known frequency signal corresponding to the known fundamental frequencies of the unwanted repetition phenomena is generated. A plurality of sensors are employed in which each sensor senses residual phenomena and generates an electrical residual phenomena signal representative of the residual phenomena. A plurality of actuators are provided for cancelling phenomena signals at a plurality of locations, and a controller is utilized for automatically controlling each of the actuators as a predetermined function of the known fundamental frequencies of the unwanted repetitive phenomena and of the residual phenomena signals from the plurality of sensors. In this arrangement the plurality of actuators operate to selectively cancel discrete harmonics of the known fundamental frequencies while accommodating interactions between the various sensors and actuators.

6 Claims, 5 Drawing Sheets

REPETITIVE PHENOMENA CANCELLATION ARRANGEMENT WITH MULTIPLE SENSORS AND ACTUATORS

BACKGROUND OF THE INVENTION

The present invention relates to the development of an improved arrangement for controlling repetitive phenomena cancellation in an arrangement wherein a plurality of residual repetitive phenomena sensors and a plurality of cancelling actuators are provided. The repetitive phenomena being cancelled in certain cases may be unwanted noise, with microphones and loudspeakers as the repetitive phenomena sensors and cancelling actuators, respectively. The repetitive phenomena being cancelled in certain other cases may be unwanted physical vibrations, with vibration sensors and counter vibration actuators as the repetitive phenomena sensors and cancelling actuators, respectively.

A time domain approach to the noise cancellation problem is presented in a paper by S. J. Elliott, I. M. Strothers, and P. A. Nelson, "A Multiple Error LMS Algorithm and Its Application to the Active control of Sound and Vibration," IEEE Transactions on Accoustics, Speech, and Signal Processing, VOL. ASSP-35, No. 10, October 1987, pp. 1423-1434.

The approach taught in the above paper generates cancellation actuator signals by passing a single reference signal derived from the noise signal through Na FIR filters whose taps are adjusted by a modified version of the LMS algorithm. The assumption that the signals are sampled synchronously with the noise period is not required. In fact, the above approach does not assume that the noise signal has to be periodic in the first part of the paper. However, the above approach does assume that the matrix of impulse responses relating the actuator and sensor signals is known. No suggestions on how to estimate the impulse responses are made.

The frequency domain approach to the interpretation of the problem is presented as follows, as shown in FIG. 5 which is a block diagram of the system:

The system consists of a set of Na actuators driven by a controller that produces a signal C which is a Na×1 column vector of complex numbers. A set of Ns sensors measures the sum of the actuator signals and undesired noise. The sensor output is the Ns×1 residual vector R which at each harmonic has the form $$R=V+HC \tag{1}$$

where

V is a Ns×1 column vector of noise components and

H is the Ns×Na transfer function matrix between the actuators and sensors at the harmonic of interest.

The problem addressed by the present invention is to choose the actuator signals to minimize the sum of the squared magnitudes of the residual components. Suppose that the actuator signals are currently set to the value C which is not necessarily optimum and that the optimum value is Copt=C+dC. The residual with Copt would be $$Ro=H\,(C+dC)+V=(HC+V)+H\,dC=R+H\,dC \tag{2}$$

The problem is to find dC to minimize the sum squared residual

Ro@Ro where @ denotes conjugate transpose. An equivalent statement of the problem is: Find dC so that H dC is the least squares approximation to −R. This problem will be represented by the notation $$-R==H\,dC \tag{3}$$

The solution to the least squares problem has been studied extensively. One approach is to set the derivatives of the sum squared error with respect to the real and imaginary parts of the components of dC equal to 0. This leads to the "normal equations"

$$H@\,H\,dC=-H@R \tag{4}$$

If the columns of H are linearly independent, the closed form solution for the required change in C is $$dC=-[H@H]^{-1}H@R \tag{5}$$

The present invention provides methods and arrangements for accommodating the interaction between the respective actuators and sensors without requiring a specific pairing of the sensors and actuators as in prior art single point cancellation techniques such as exemplified by U.S. Pat. No. 4,473,906 to Warnaka, U.S. Pat. Nos. 4,677,676 and 4,677,677 to Eriksson, and U.S. Pat. Nos. 4,153,815, 4,417,098 and 4,490,841 to Chaplin. The present invention is also a departure from prior art techniques such as described in the above-mentioned Elliot et al. article and U.S. Pat. No. 4,562,589 to Warnaka which handle interactions between multiple sensors and actuators by using time domain filters which do not provide means to cancel selected harmonics of a repetitive phenomena.

SUMMARY OF THE INVENTION

Accordingly, one object of the present invention is to provide novel equipment and algorithms to cancel repetitive phenomena which are based on known fundamental frequencies of the unwanted noise or other periodic phenomena to be cancelled. Each of the preferred embodiments provides for the determination of the phase and amplitude of the cancelling signal for each known harmonic. This allows selective control of which harmonics are to be cancelled and which are not. Additionally, only two weights, the real and imaginary parts, are required for each harmonic, rather than long FIR filters.

Accordingly, another object of the present invention is to provide novel equipment and methods for measuring the transfer function between the respective actuators and sensors for use in the algorithms for control functions.

Different equipment and methods are used for determining the known harmonic frequencies contained in the unwanted phenomena to be cancelled. In environments such as cancellation of noise generated by a reciprocating engine or the like, a sync signal representation of the engine speed is supplied to the controller, which sync signal represents the known harmonic frequencies to be considered. In other embodiments, the known harmonic frequencies can be determined by manual tuning to set the controller based on the residual noise or vibration signal. It should be understood that in most applications, a plurality of known harmonic frequencies make up the unwanted repetitive phenomena signal field and the embodiments of the invention are intended to address the cancellation of selected ones of a plurality of the known harmonic frequencies.

Other objects, advantages and novel features of the present invention will become apparent from the following detailed description of the invention when considered in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
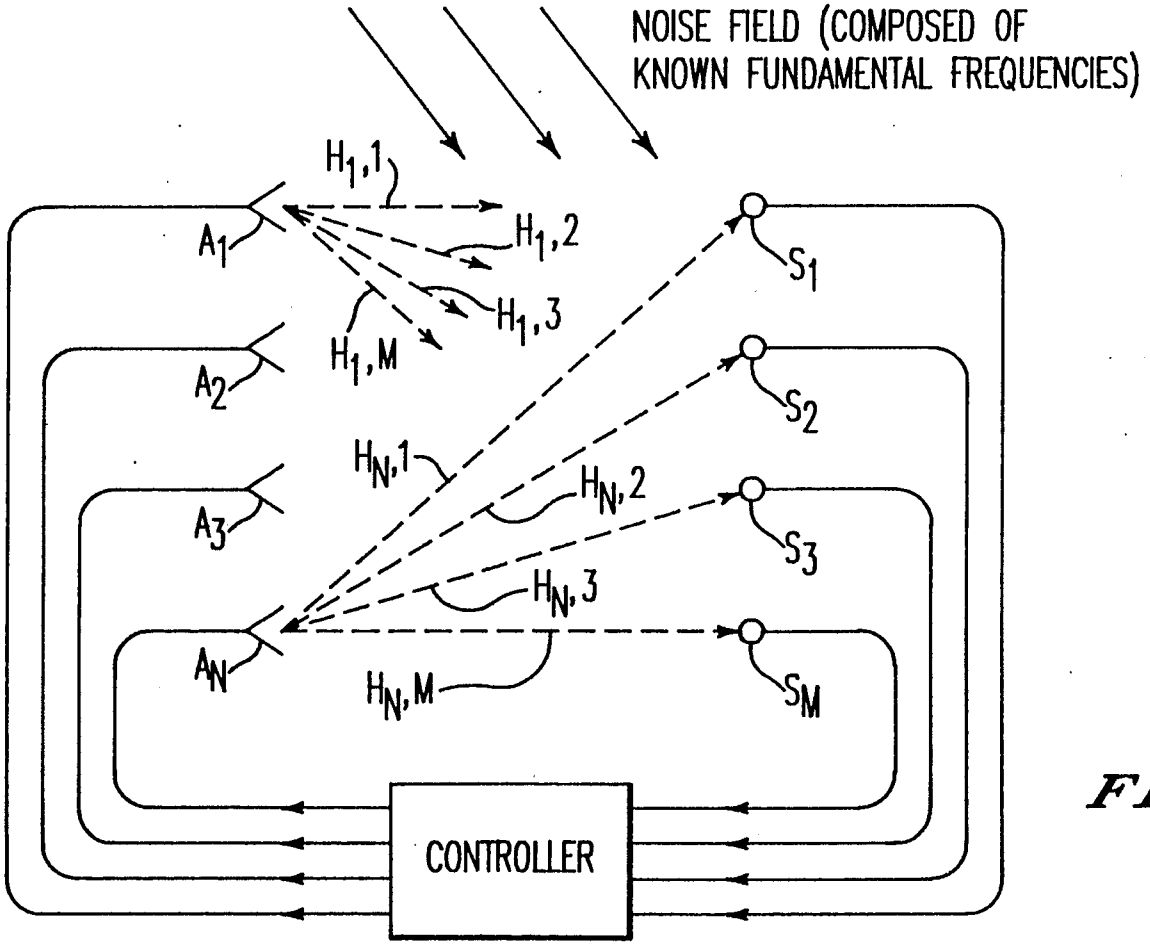
FIG. 1 schematically depicts a preferred embodiment of the invention for cancelling noise in an unwanted noise field.

Referring now to the drawings, wherein like reference symbols designate identical or corresponding parts throughout the several views, and more particularly to FIG. 1 which schematically depicts a preferred embodiment of the present invention with multiple actuators (speakers $A_1, A_2 \ldots, A_n$) and multiple sensors (microphones $S_1, S_2 \ldots, S_m$). In FIG. 1, the dotted lines between the actuator $A_1$ and the sensors, marked as $H_{1,1}$; $H_{1,2} \ldots$, represent transfer functions between speaker $A_1$ and each of the respective sensors. In a like manner, the dotted lines $H_{n1}$; $H_{n2}$. emanating from speaker $A_n$, represent the transfer functions between speaker $A_n$ and each of the sensors. The CONTROLLER includes a microprocessor and is programmed to execute algorithms based on the variable input signals from the sensors $S_1 \ldots$ to control the respective actuators $A_1 \ldots$.

A first frequency domain approach solution according to the present invention can be applied to the case of periodic noise and synchronous sampling. It will be assumed that all signals are periodic with period $T_o$ and corresponding fundamental frequency $w_o = 2\ pi/T_o$ and that the sampling rate, $w_s$, is an integer multiple of the fundamental frequency $w_o$, i.e., $w_s = N\ w_o$. The sampling period will be denoted by $T = 2\ pi/w_s = T_o/N$. The sampling rate must also be at least twice the highest frequency component in the noise signal. Let the transfer function from actuator q to sensor p at frequency $mw_o$ be $$H_{pq}(m) = F_{pq}(m) + j\,G_{pq}(m) = |H_{pq}(m)|\ e^{j\,b_{pq}(m)} \tag{6}$$

where F and G are the real and imaginary parts of H and b is its phase. The signals applied to the actuators will be sums of sinusoids at the various harmonics and the amplitudes and phases of these sinusoids will be adjusted to minimize the sum squared residual. Actually, it will be more convenient to decompose each sinusoid into a weighted sum of a sine and cosine and adjust the two weights to achieve the desired amplitude and phase. This is equivalent to using rectangular rather than polar coordinates. Let the signal at actuator q and harmonic m be $$\begin{aligned} c_q(t;m) &= x_{q,m}\cos mw_o t - y_{q,m}\sin mw_o t \\ &= Re[(x_{q,m} + j\,y_{q,m})\exp(jmw_o t)] \\ &= Re[C_{q,m}\exp(jmw_o t)] \end{aligned} \tag{7}$$

where $$C_{q,m} = x_{q,m} + j\,y_{q,m}$$

According to sinusoidal steady-state analysis, the signal caused at sensor p by this actuator signal is $$\begin{aligned} u_{pq}(t;m) &= Re[(x_{q,m} + j\,y_{q,m})\,H_{pq}(m)\exp(jmw_o t)] \\ &= Re[C_{q,m}H_{pq}(m)\exp(jmw_o t)] \end{aligned} \tag{8}$$

Therefore, the total signal observed at sensor p is $$\begin{aligned} r_p(t) &= \sum_{m=1}^{Nh}\sum_{q=1}^{Na} u_{pq}(t;m) + v_p(t) \\ &= \sum_{m=1}^{Nh}\sum_{q=1}^{Na} Re[C_{q,m}\,H_{pq}(m)\exp(jmw_o t)] + v_p(t) \end{aligned} \tag{9}$$

where $t = nT$

Nh is the number of significant harmonics, and $v_p(t)$ is the noise observed at sensor p.

Since the noise is periodic, it can also be represented as $$v_p(t) = \sum_{m=1}^{Nh} Re[V_{p,m}\exp(jmw_o t)] \tag{10}$$

Thus, the residual component at harmonic m is $$r_p(t;m) = Re\left\{\left[V_{p,m} + \sum_{q=1}^{Na} C_{q,m}H_{pq}(m)\right]\exp(jmw_o t)\right\} \tag{11}$$

The problem is to choose the set of complex numbers $\{C_{q,m}\}$ so as to minimize the squared residuals summed over the sensors and time. Since the signals are periodic with a period of N samples, the sum will be taken over just one period in time. The quantity to be minimized is $$Q = \sum_{p=1}^{Ns}\sum_{n=0}^{N-1} r_p^2(nT) \tag{12}$$

Since the sinusoidal components at different harmonics are orthogonal, it follows that $$Q = \sum_{m=1}^{Nh} Q_m$$

where $$Q_m = \sum_{p=1}^{Ns} \sum_{n=0}^{N-1} r_p^2(nT;m) \tag{13}$$

Consequently, the sum squared residuals at each harmonic can be minimized independently. Taking a derivative with respect to $x_{k,m}$ gives $$\begin{aligned} dQ_m/dx_{k,m} &= 2 \sum_{p=1}^{Ns} \sum_{n=0}^{N-1} r_p(nT;m)\, d\, r_p(nT;m)/dx_{k,m} \\ &= 2 \sum_{p=1}^{Ns} \sum_{n=0}^{N-1} r_p(nT;m) Re[H_{pk}(m) \exp(jmw_o nt)] \end{aligned} \tag{14}$$

Similarly, the derivative with respect to $Y_{k,m}$ is $$dQ_m/dy_{k,m} = -2 \sum_{p=1}^{Ns} \sum_{n=0}^{N-1} r_p(nT;m) Im[H_{pk}(m) \exp(mw_o nT)] \tag{15}$$

Equations 14 and 15 can be conveniently combined into $$\begin{aligned} dQ_m/dC_{k,m} &\overset{\Delta}{=} dQ_m/dx_{k,m} + j\, dQ_m/dy_{k,m} = \\ & 2 \sum_{p=1}^{Ns} H^*_{pk}(m) \sum_{n=0}^{N-1} r_p(nT;m) \exp(-jmw_o nT) = \\ & 2 \sum_{p=1}^{Ns} H^*_{pk}(m)\, R_{p,m} \end{aligned} \tag{16}$$

where

* denotes complex conjugate and $$\begin{aligned} R_{p,m} &= \sum_{n=0}^{n-1} r_p(nT;m) \exp(-jmw_o nT) \\ &= \sum_{n=0}^{N-1} r_p(nT;m) \exp(-j\, 2\, pi\, mn/N) \end{aligned} \tag{17}$$

Notice that $R_{p,m}$ is the DFT of $r_p(nT)$ evaluated at harmonic m. The sum squared error can be minimized by incrementing the C's in the directions opposite to the derivatives. Let $C_{k,m}(i)$ be a coefficient at iteration i. Then the iterative algorithm for computing the optimum coefficients is $$C_{k,m}(i+1) = C_{k,m}(i) - a \sum_{p=1}^{Ns} H^*_{pk}(m)\, R_{p,m} \tag{18}$$

for K=1, Na and m=1, . . . , Nh.

where a=small positive constant.

The above derivation of equation (18) is based on the assumption that the system has reached steady state. To apply this method, the C coefficients are first incremented according to (18). Before another iteration is performed, the system must be allowed to reach steady state again. The time delay required depends on the durations of the impulse responses from the actuators to the sensors.

If synchronous sampling cannot be performed, then the algorithm represented by equation (18) cannot be used. However, if the noise is periodic with a known period, the method can be modified to give, perhaps, an even simpler algorithm that can be used whether the sampling is synchronous or not. This algorithm is presented below and provides for the case where the noise is periodic and sampling can be either synchronous or asynchronous. An algorithm that does not require synchronous sampling or DFT's is presented. However, it is still assumed that the noise is periodic with known period and that the actuator signals are sums of sinusoids at the fundamental and harmonic frequencies just as in the previous paragraphs.

Let the instantaneous sum squared residual be $$Q(n) = \sum_{p=1}^{Ns} r_p^2\,(nT) \tag{19}$$

It will still be assumed that the actuator signals are given by (7) and the signals observed at the sensors are given by (9). Then, in a manner similar to that used in the previous paragraphs, it can be shown that the gradient of the instantaneous sum squared residual with respect to a complex tap is $$dQ/dC_{k,m} = dQ/dx_{k,m} + j\, dQ/dy_{k,m} = 2 \sum_{p=1}^{Ns} [H^*pk(m)\exp(-jmw_o nT)]\, r_p(nT) \tag{20}$$

Notice that the term in rectangular brackets is the complex conjugate of the signal applied to actuator k at harmonic m and filtered by the path from actuator k to sensor p except that the tap $C_{k,m}$ is not included. Equation 20 suggests the following approximate gradient tap update algorithm.

$$C_{k,m}(n+1) = C_{k,m}(n) - a \sum_{p=1}^{Ns} H^*pk(m)\exp(-jmw_o nT)\, r_p(nT) \tag{21}$$

Again "a" is a small positive constant that controls the speed of convergence.

To utilize the above algorithms to cancel repetitive phenomena the transfer functions $$Hpq$$

between each repetitive phenomena sensor p and each cancelling actuator q must be known. Below are discussed several techniques which can be implemented to determine these transfer functions.

A first approach of determining the transfer functions will now be described where the signals involved will again be assumed to be periodic with all measurements made over periods of time when the system is in steady state. In the frequency domain at harmonic m and iteration n, the sensor and actuator components are assumed to be related by the matrix equation $$R(n) = V + H\, C(n) \tag{22}$$

where

Na is the number of actuators

Ns is the number of sensors

R(n) is the Ns×1 column vector of sensor values

V is the Ns×1 column vector of noise values

H is the Ns×Na matrix of transfer functions

C(n) is the Na×1 column vector of actuator inputs,

The noise vector V and transfer function H are assumed to remain constant from iteration to iteration.

The approach to estimating H is to find the values of H and V that minimize the sum of the squared sensor values over several iterations. Let $R_i(n)$ be the i-th row of R(n) at iteration n $V_i$ be the i-th element of V, and $H_i$ be the i-th row of H Then the residual signal observed at sensor i and iteration n is $$R_i(n) = [1\ C^t(n)] \begin{bmatrix} V_i \\ H_i^t \end{bmatrix} \tag{23}$$

for i=1, . . . , Ns. The superscript t denotes transpose. When N measurements are made, they can be arranged in the matrix equation $$\begin{bmatrix} R_i(1) \\ R_i(2) \\ \cdot \\ \cdot \\ \cdot \\ R_i(N) \end{bmatrix} = \begin{bmatrix} 1\ C^t(1) \\ 1\ C^t(2) \\ \cdot \\ \cdot \\ \cdot \\ 1\ C^t(N) \end{bmatrix} \begin{bmatrix} V_i \\ H_i^t \end{bmatrix} \tag{24}$$

or $$R_i = A\ X_i$$

Minimizing the squares of the residuals summed over all the sensors and all times from 1 to N is equivalent to minimizing the sums of the squares of the residuals over time at each sensor individually since the far right hand matrix in (24) is distinct for each i. Therefore, we have Ns individual least squares minimization problems. The least squares solution to (24) is $$X_i = [A@A]^{-1} A@R_i \tag{25}$$

where @ designates conjugate transpose. The columns of A must be linearly independent for the inverse in (25) to exist. Therefore, care must be taken to vary the C's from sample to sample in such a way that the columns of A are linearly independent. The number of measurements, N, must be at least one larger than the number of actuators for this to be true. One approach is to excite the actuators one at a time to get Na measurements and then make another measurement with all the actuators turned off. Suppose that at time n the n-th actuator input is set to the value K(n) with all the others set to zero at time n. Then the solution to (24) becomes $$R_i(Na+1) = V_i$$

in measurement Na+1 when all the actuators are turned off and then $$H_{i,n} = [R_i(n) - V_i]/K(n) \text{ for } n = 1, \ldots, Na \tag{26}$$

Of course, this approach gives no averaging of random measurement noise. Additional measurements must be taken to achieve averaging.

A second method of determining the transfer functions is a technique which estimates the transfer functions by using differences. Again, it will be assumed that the observed sensor values are given by (22) with the noise, V, and transfer function, H, constant with time. The noise remains constant because it is assumed to be periodic and blocks of time samples are taken synchronously with the noise period before transformation to the frequency domain. A transfer function estimation formula that is simpler than the one presented in the previous subsection can be derived by observing that the noise component cancels when two successive sensor vectors are subtracted. Let the actuator values at times n and n+1 be related by $$C(n+1) = C(n) + dC(n) \tag{27}$$

Then the difference of two successive sensor vectors is $$R(n+1) - R(n) = H\ dC(n) \tag{28}$$

Suppose that the present estimate of the transfer function matrix is Ho and that the actual value is $$H = Ho + dH \tag{29}$$

Replacing H in (28) by (29) and rearranging gives $$Q(n) = R(n+1) - R(n) - \text{Ho dC}(n) = dH\ dC(n) \tag{30}$$

Notice that Q(n) is a known quantity since R(n+1) and R(n) are measured, Ho is the known present transfer function estimate and dC(n) is the known change in the actuator signal at time n.

In practice, Q(n) in (30) will not be exactly equal to the right hand side because of random measurement noise. The approach that will be taken is to choose dH to minimize the sum squared residuals. Suppose Ho is held constant and measurements are taken for n=1, . . . ,N. Let $dH_i$ designate the i-th row of dH. Then the signals observed at the i-th sensor are $$\begin{bmatrix} Q_i(1) \\ \cdot \\ \cdot \\ \cdot \\ Q_i(N) \end{bmatrix} = \begin{bmatrix} dC^t(1) \\ \cdot \\ \cdot \\ \cdot \\ dC^t(N) \end{bmatrix} dH_i^t \tag{31}$$

or $$Q_i = B\ dH^t_i$$

The least squares solution to (31) is $$dH^t_i = (B@B)^{-1} B@Q_i \tag{32}$$

For this solution to exist, the actuator changes must be chosen so that the columns of B are linearly independent. This solution can also be expressed as $$dH_i^t = \left[ \sum_{n=1}^{N} dC^*(n)\ dC^t(n) \right]^{-1} \sum_{n=1}^{N} dC^*(n)\ Q_i(n) \tag{33}$$

The solution becomes simpler if only one actuator is changed at a time. Suppose only actuator m is changed and all the rest are held constant for N sample blocks. Let $dH_{i,m}$ be the i,m-th element of dH and $C_m(n)$ be the m-th element of the column vector C(n). Assume that $$dC_i(n) = 0 \text{ for i not equal to m}$$

then (31) reduces to $$\begin{bmatrix} Q_i(1) \\ \cdot \\ \cdot \\ Q_i(N) \end{bmatrix} = \begin{bmatrix} dC_m(1) \\ \cdot \\ \cdot \\ dC_m(N) \end{bmatrix} dH_{i,m} \tag{34}$$

or $$Q_i = D\ dH_{i,m}$$

The least squares solution to (34) is $$\begin{aligned} dH_{i,m} &= (D@D)^{-1} D@Q_i \\ &= \sum_{n=1}^{N} Q_i(n) \left[ dC^*_m(n) / \sum_{p=1}^{N} |dC_m(p)|^2 \right] \end{aligned} \tag{35}$$

If all the $dC_m$'s are the same, (35) reduces to $$dH_{i,m} = \frac{1}{N} \sum_{n=1}^{N} Q_i(n)/dC_m \tag{36}$$

which is just the arithmetic average of the estimates based on single samples.

Another approach is to make a change dC(1) in the actuator signals initially and then make no changes for n=2, . . . ,N. Consider the difference $$R(n+1) - R(1) = H\,[C(n+1) - C(1)] = H\ dC(1) \tag{37}$$

for n=1, . . . ,N. Letting H=Ho+dH as before gives $$P(n) = R(n+1) - R(1) - Ho\ dC(1) = dH\ dC(1) \tag{38}$$

The development can proceed along the same lines as the previous paragraph. Suppose a change is made only in actuator m and $P_i(n)$ is observed for i=1, . . .N. Then the least squares solution for $dH_{i,m}$ is $$dH_{i,m} \frac{1}{N} \sum_{n=1}^{N} P_i(n)/dC_m(1) \tag{39}$$

Another method for determining a transfer function which is closely related to the first method described earlier can be utilized in that from (30) it follows that $$Q_i(n) = \sum_{k=1}^{Na} dH_{i,k} dC_k(n) \tag{40}$$

Now assume that actuator changes $dC_i(n)$ are uncorrelated for different values of i. Then $$\begin{aligned} E[Q_i(n)\ dC^*_m(n)] &= \sum_{k=1}^{Na} dH_{i,k} E[dC_k(n) dC^*m(n)] \\ &= E[|dC_m(n)|^2]\ dH_{i,m} \end{aligned} \tag{41}$$

where E[ ] denotes expectation. This average results in a quantity proportional to the required change in the transfer function element. This observation suggests the following formula for updating the transfer function elements $$H_{i,m}(n+1) = H_{i,m}(n) + a\ Q_i(n)\ dC^*_m(n) \tag{42}$$

As an example, "a" can be chosen to be $$a = 0.5/(1 + \|dC(n)\|^2) \tag{43}$$

Notice that in the solution given by (32), the product on the right hand side of (42) corresponds to the matrix $B@Q_i$. The matrix $[B@B]^{-1}$ forms a special set of update scale factors.

The transfer function identification methods described in the second method which uses differences require that the actuators be excited with periodic signals that contain spectral components at all the significant harmonics present in the noise signal. The harmonics can be excited individually. However, since the sinusoids at the different harmonics are orthogonal, all the harmonics can be present simultaneously. The composite observed signals can then be processed at each harmonic. Care must be taken in forming the probe signals since sums of sinusoids can have large peak values for some choices of relative phase. These peaks could cause nonlinear effects such as actuator saturation.

Good periodic signals are described in the following two articles:

D. C. Chu, "Polyphase Codes with Good Periodic Correlation Properties," IEEE Transactions on Information Theory, July 1972, pp. 531–532.

A. Milewski, "Periodic Sequences with Optimal Properties for Channel Estimation and Fast Start-up Equalization," IBM Journal of Research and Development, Vol. 27, No. 5, September 1983, pp. 426–431.

These sequences have constant amplitude and varying phase. The autocorrelation functions are zero except for shifts that are multiples of the sequence period. They are called CAZAC (constant amplitude, zero autocorrelation) sequences. This special autocorrelation property causes the signals to have the same power at each of the harmonics. Using a probe signal with a flat spectrum is a quite reasonable approach.

The CAZAC signals are complex. To use them in a real application, they should be sampled at a rate that is at least twice the highest frequency component and then the real part is applied to the DAC.

A fourth method of determining transfer functions $Hpq$ is by utilizing pseudo-Noise sequences. Pseudo-Noise actuator signals can be used to identify the actuator to sensor impulse responses. Then the transfer functions can be computed from the impulse responses. Let $h_{i,j}(n)$ be the impulse response from actuator j to sensor i. Then Ns×Na impulse responses must be measured. The corresponding frequency responses can be computed as $$H_{i,j}(w) = \sum_{n=0}^{Nh} h_{i,j}(n) \exp(-jwnT) \tag{44}$$

where Nh is the number of non-zero impulse response samples and T is the sampling period. The sampling rate must be chosen to be at least twice the highest frequency of interest.

Suppose that only actuator m is excited and let the pseudo-noise driving signal be d(n). Then the signal observed at sensor i is $$r_i(n) = \sum_{k=0}^{Nh} h_{i,m}(k)d(n-k) + v_i(n) \quad (45)$$

where $v_i(n)$ is the external noise signal observed at sensor i. Let the present estimate of the impulse response be $h\#_{i,m}(n)$. Then the estimated sensor signal without noise is $$r_i^{\#}(n) = \sum_{k=0}^{Nh} h_{i,m}^{\#}(k)d(n-k) \quad (46)$$

The instantaneous squared error is $$e^2(n)=[r_i(n)-r\#_i(n)]^2 \quad (47)$$

and its derivative with respect to the estimated impulse response sample at time q is $$de^2(n)/dh\#_{i,m}(q)=-2\,e(n)\,d(n-q) \quad (48)$$

This suggests the LMS update algorithm $$h\#_{i,m}(q;n+1)=h\#_{i,m}(q;n)+a\,e(n)\,d(n-q) \quad (49)$$

For this algorithm to work, the pseudo-noise signal d(n) must be uncorrelated with the external noise $v_i(n)$. This can be easily achieved by generating d(n) with a sufficiently long feedback shift register.

The problem becomes more complicated if all the actuators are simultaneously excited by different noise sequences. Then, these different sequences must be uncorrelated. Sets of sequences called "Gold codes" with good cross-correlation properties are known. However, exciting all the actuators simultaneously will increase the background noise and require a smaller update scale factor "a" to achieve accurate estimates. This will slow down the convergence of the estimates.

A two actuator and three sensor noise canceller arrangement was simulated by computer to verify the cancellation algorithm (21). The simulation program ADAPT.FOR, following below, was used and was compiled using MICROSOFT FORTRAN, ver. 4.01.

Sinusoidal signals with known frequencies and the outputs of the filters from the actuators to the sensors were computed using sinusoidal steady-state analysis. If the actuator taps are updated at the sampling rate, this steady-state assumption is not exactly correct. However, it was assumed to be accurate when the tap update scale factor is small so that the taps are changing slowly. To test this assumption, six filters were simulated by 4-tap FIR filters with impulse responses G(P,K,N) where P is the sensor index, K is the actuator index, and N is the sample time. The exact values used are listed in the program. The required transfer functions are computed as $$H(P,K) = \sum_{N=0}^{3} G(P,K,N)\exp(-j*2*pi*N*f/fs) \quad (50)$$

where f is the frequency of the signals and fs is the sampling rate. The normalized frequency FN=f/fs is used in the program.

Let the complex actuator tap values at time N be $$C(K,N)=X(K,N)+j\,Y(K,N) \quad (51)$$

Then, according to Equation (21) the updating algorithm is $$C(K,N+1) = C(K,N) - a\sum_{P=1}^{3} H^*(P,K)\exp(-j*2*pi*N*f/fs)R(P,N) \quad (52)$$

where R(P,N) is the residual measured at sensor P at time N. The following two real equations are used for computing (21) in the program $$X(K,N+1) = X(K,N) - a\sum_{P=1}^{3} Re[H(P,K)\exp(j*2*pi*N*f/fs)R(P,N)] \quad (53)$$

$$Y(K,N+1) = Y(K,N) + a\sum_{P=1}^{3} Im[H(P,K)\exp(j*2*pi*N*f/fs)R(P,N)] \quad (54)$$

The external noise signals impinging on the sensors are modeled as $$V(P,N)=AV(P)\cos(2*pi*N*f/fs-pi*PHV(P)/180 \quad (55)$$

in the program where PHV(P) is the degrees.

Figure 2:
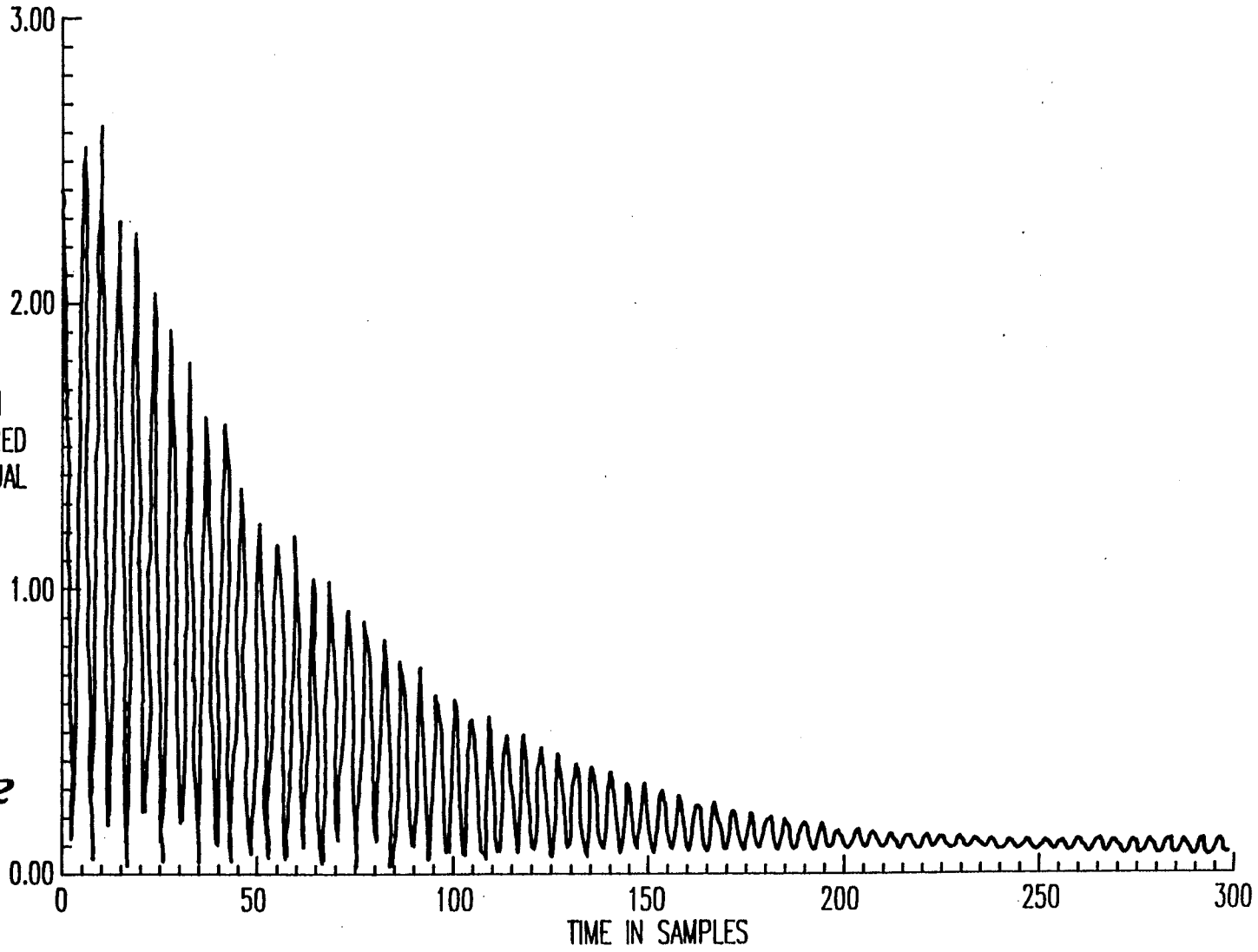
FIG. 2 is a graph showing convergence of sum squared residuals for a first set of variables.
Figure 3:
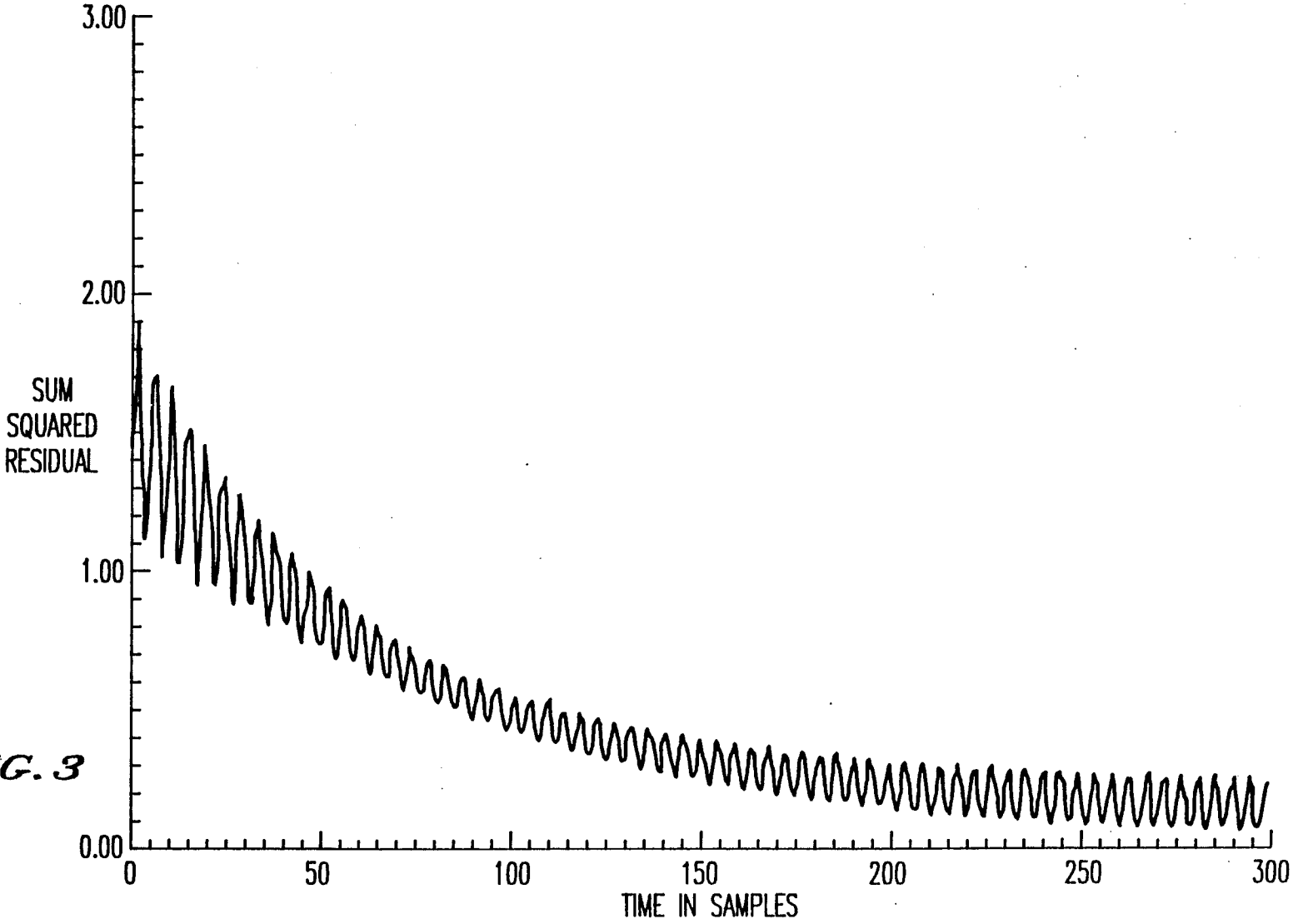
FIG. 3 is a graph showing convergence of sum squared residuals, for another set of variables.
Figure 4:
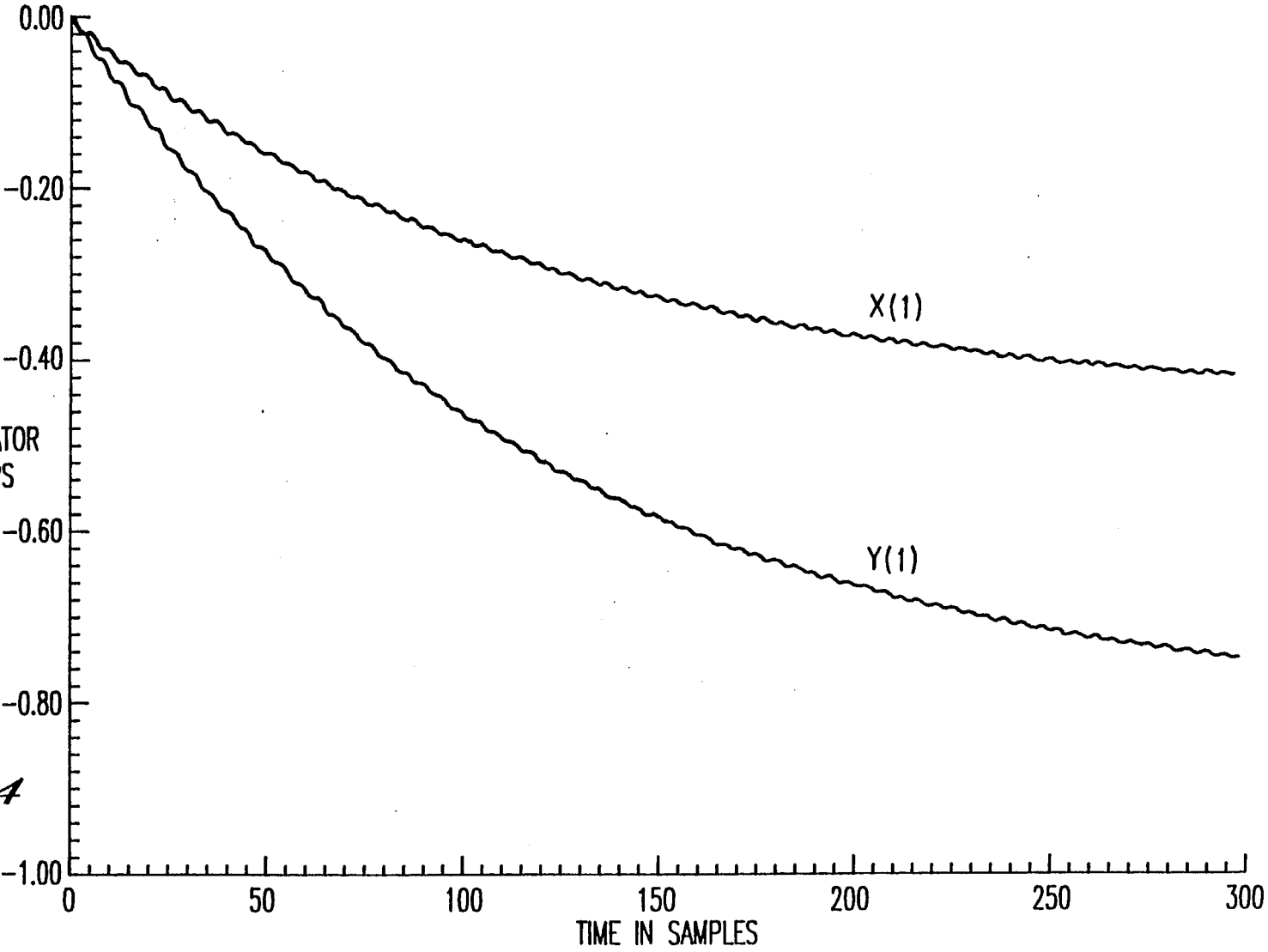
FIG. 4 is a graph showing the convergence of real and imaginary parts of an actuator tap.
Figure 5:
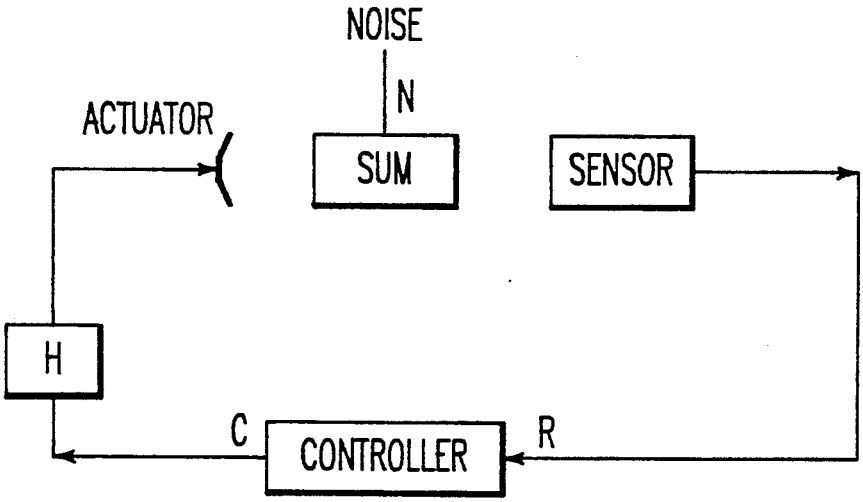
FIG. 5 is a block diagram of the environment of the present invention.

Typical results are shown in FIGS. 2, 3, and 4. FIG. 2 shows the convergence of the sum squared residual for AV(1)=AV(2)=AV(3)=1 and PHV(1)=PHV(2)=PHV(3)=0. FIG. 4 shows the convergence of the real and imaginary parts of the actuator 1 tap. FIG. 3 shows the convergence of the sum squared residual for AV(1)=AV(2)=AV(3)=1 and PHV(1)=0, PHV(2)=40, and PHV(3)=95 degrees. The algorithm converges as expected. The final value for the sum squared residual depends on the transfer functions from the actuators to the sensors as well as the external noise arriving at the sensors. Each combination results in a different residual.

Although the invention has been described and illustrated in detail, it is to be clearly understood that the same is by way of illustration and example, and is not to be taken by way of limitation. The spirit and scope of the present invention are to be limited only by the terms of the appended claims.

```
THE MODEL FOR THIS PROGRAM USES TWO ACTUATORS AND
THREE SENSORS.  THE TRANSFER FUNCTIONS FROM ACTUATOR K
TO SENSOR P, H(P,K), ARE REALIZED BY 4 TAP FIR FILTERS,
G(P,K,N), TO CHECK THE DYNAMIC BEHAVIOR OF THE ADAPTIVE
SCHEME.  ALL INPUT SIGNALS ARE ASSUMED TO HAVE THE SAME
FREQUENCY, THAT IS, ONLY ONE HARMONIC IS CONSIDERED. THE
NORMALIZED FREQUENCIES FN = F/FS ARE USED, WHERE FS IS
THE SAMPLING FREQUENCY IN HZ.
```

```
G(P,K,N) IS THE IMPULSE RESPONSE SAMPLE AT TIME N FROM
   ACTUATOR K TO SENSOR P.
     REAL  G(3,2,0:3)
GDATA(K,N) IS THE DELAY LINE FOR THE FILTER BETWEEN
   ACTUATOR K AND SENSOR P.  NOTICE THAT ALL THE FILTERS
   FROM SENSOR K HAVE THE SAME INPUTS SO ONLY 2 DELAY LINES
   ARE NEEDED, ONE FOR ACTUATOR 1 AND ONE FOR ACTUATOR 2.

     REAL  GDATA(2,0:3)

H(P,K) IS THE TRANSFER FUNCTION FROM ACTUATOR K TO
   SENSOR P AT THE FREQUENCY OF THE HARMONIC BEING
   CANCELLED.
     COMPLEX H(3,2),Z,ZZ

THE ACTUATOR TAP VALUES ARE DESIGNATED BY
   C(K) = X(K) + j Y(K)  FOR K = 1,2

     REAL  X(2),Y(2)

S(1) AND S(2) ARE THE ACTUATOR INPUT SIGNALS
     REAL S(2)

SG(P,K) ARE THE OUTPUTS OF THE FILTERS FROM ACTUATOR
   K TO SENSOR P

     REAL SG(3,2)

R(P) ARE THE OUTPUTS OF SENSOR 1, 2, AND 3

     REAL R(3)

V(P) ARE THE EXTERNAL NOISE INPUTS AT EACH SENSOR

     REAL V(3)

     INTEGER P

AV(P) ARE THE EXTERNAL NOISE AMPLITUDES

     REAL AV(3)

PHV(P)ARE THE EXTERNAL NOISE PHASES IN DEGREES

     REAL PHV(3)
     WRITE(*,'(A\)') ' ENTER NOISE AMPLITUDES AV(1), AV(2), AV(3): '
     READ(*,*) AV(1), AV(2), AV(3)
     WRITE(*,'(A\)') ' ENTER NOISE PHASES PHV(1), PHV(2), PHV(3) IN D
  1EGREES: '
     READ(*,*) PHV(1),PHV(2),PHV(3)

ALPHA = TAP UPDATE SCALE FACTOR

     WRITE(*,'(A\)') ' ENTER UPDATE SCALE FACTOR ALPHA: '
     READ(*,*) ALPHA

     PI = 3.141592653589
     PI2 = 2*PI

INITIALIZE THE IMPULSE RESPONSES TO (AN ARBITARY CHOICE)

                N = 0   1  2  3
```

```
      G(1,1,N) <--> 0    1   0   0
      G(2,1,N) <--> 0    0  .5   0
      G(3,1,N) <--> 0    0   0  .25

      G(1,2,N) <--> 0    0   0   .25
      G(2,2,N) <--> 0    0   .5    0
      G(3,2,N) <--> 0    1   0     0

      DATA G/24*0/
      G(1,1,1) = 1
      G(2,1,2) = 0.5
      G(3,1,3) = 0.25
      G(1,2,3) = 0.25
      G(2,2,2) = 0.5
      G(3,2,1) = 1

      WRITE(*,'(A\)') ' ENTER THE NORMALIZED SIGNAL FREQUENCY = '
      READ(*,*) FN
      WRITE(*,'(A\)') ' ENTER NUMBER OF ITERATIONS: '
      READ(*,*) NTIMES

      OPEN(1,FILE='JUNK1.DAT',STATUS='UNKNOWN')
      OPEN(2,FILE='JUNK2.DAT',STATUS='UNKNOWN')
      OPEN(3,FILE='JUNK3.DAT',STATUS='UNKNOWN')
      OPEN(4,FILE='JUNK4.DAT',STATUS='UNKNOWN')

 COMPUTE THE TRANSFER FUNCTIONS H(P,K)

      Z = CEXP(CMPLX(0.,-PI2*FN))
      DO 2 K = 1,2
      DO 2 P = 1,3
         H(P,K) = (0.,0.)
         DO 3 N = 0,3
 3         H(P,K) = H(P,K) + G(P,K,N)*Z**N
       CONTINUE
*************************************************************
  NOW START PROCESSING SIGNAL SAMPLES

       DO 1000 NNN = 0,NTIMES

  FORM THE INPUT SAMPLES FOR ACTUATORS 1 AND 2
       S(K,N) = RE[ C(K)*EXP(j*PI2*N*FN) ]
              = X(K)*COS(PI2*N*FN) - Y(K)*SIN(PI2*N*FN)

       DO 4 K=1,2
 4     S(K) = X(K)*COS(PI2*NNN*FN) - Y(K)*SIN(PI2*NNN*FN)

  SHIFT THE INPUT SAMPLES INTO THE FIR FILTERS

       DO 5 K = 1,2
         DO 6 N=3,1,-1
   6       GDATA(K,N) = GDATA(K,N-1)
5      GDATA(K,0) = S(K)

  COMPUTE THE OUTPUTS OF THE FIR FILTERS

       DO 7 P = 1,3
       DO 7 K = 1,2
         SG(P,K) = 0
         DO 8 N = 0,3
  8      SG(P,K) = SG(P,K) + GDATA(K,N)*G(P,K,N)
```

```
7       CONTINUE

  FORM THE SENSOR OUTPUTS R(P)

        DO 9 P = 1,3
          V(P) = AV(P)*COS(PI2*FN*NNN - PHV(P)*PI/180.)
          R(P) = 0
          DO 10 K = 1,2
10        R(P) = SG(P,K) + R(P)
          R(P) = R(P) + V(P)
-----------------------------------------------------------
 THE ACTUATOR TAPS C(1) AND C(2) WILL NOW BE UPDATED
   USING EQUATION (21) OF THE PHASE I REPORT. THIS EQUATION
   FOR THE COMPLEX TAPS HAS BEEN SEPARATED INTO TWO
   EQUATIONS HERE, ONE FOR THE REAL PART AND ONE FOR THE
   IMAGINARY PART.

        DO 11 K = 1,2
          SUMR = 0
          SUMI = 0
          DO 12 P = 1,3
          ZZ = CEXP(CMPLX(0.,PI2*FN*NNN))
          SUMR = SUMR + REAL(H(P,K)*ZZ)*R(P)
12        SUMI = SUMI + AIMAG(H(P,K)*ZZ)*R(P)

          X(K) = X(K) - ALPHA*SUMR
1         Y(K) = Y(K) + ALPHA*SUMI
-----------------------------------------------------------
    COMPUTE SUM SQUARED RESIDUAL

          RESID = R(1)**2 + R(2)**2 + R(3)**2
          WRITE(5,*) NNN,RESID

          WRITE(*,*) NNN,R(1),R(2),R(3)
          WRITE(1,*) NNN,X(1)
          WRITE(2,*) NNN,Y(1)
          WRITE(3,*) NNN,X(2)
          WRITE(4,*) NNN,Y(2)
000       CONTINUE
          END
```

What is claimed as new and desired to be secured by Letters Patent of the United States is:

1. Repetitive phenomena cancelling controller arrangement for cancelling unwanted repetitive phenomena comprising known fundamental frequencies, including:

known frequency determining means for generating an electrical known frequency signal corresponding to known fundamental frequencies of the unwanted repetition phenomena, a plurality of sensors, each sensor including means for sensing residual phenomena and for generating an electrical residual phenomena signal representative of the residual phenomena, a plurality of actuators for providing cancelling phenomena signals at a plurality of locations, and controller means for automatically controlling each of the actuators as a predetermined function of the known fundamental frequencies of the unwanted repetitive phenomena and of the residual phenomena signals from the plurality of said sensors, whereby said plurality of actuators operate to selectively cancel discrete harmonics of said known fundamental frequencies while accommodating interactions between the various sensors and actuators, said controller means including a means for sampling said residual phenomena signals synchronously with said known fundamental frequencies.

2. Repetitive phenomena cancelling controller arrangement as claimed in claim 1, wherein said unwanted repetitive phenomena is audible noise, wherein said sensors are microphones, and wherein said actuators are speakers.

3. Repetitive phenomena cancelling controller arrangement as claimed in claim 1, comprising transfer function determining means for determining a transfer function between pairs of actuators and sensors, and wherein said controller means includes means for controlling the actuators as a function of the respective transfer function between each pair of actuators and sensors.

4. Repetitive phenomena cancelling controller arrangement as claimed in claim 3, wherein said transfer function determining means includes adaptive filter means and pseudo random noise generating means.

5. Repetitive phenomena cancelling controller arrangement as claimed in claim 1, wherein said known frequency determining means samples the unwanted repetitive phenomena synchronously and the cancelling phenomena signals are generated in accordance with the iterative algorithm, $$C_{k,m}(i+1) = C_{k,m}(i) - a \sum_{p=1}^{Ns} H^*_{pk}(m) R_{p,m}$$

and $$c_k(t;m) = x_{k,m}(i) \cos mw_o t - y_{k,m}(i) \sin mw_o t$$

for k=1, . . . , Na, Na=number of actuators m=1, . . . Nh, Nh=number of significant harmonics a=small positive constant Ns=number of sensors $H^*_{pk}(m)$=the complex conjugate of a transfer function from an actuator k to a sensor p at frequency $mw_o$, where $w_o$ is a fundamental frequency $$X_{k,m}(i) + j\, y_{k,m}(i)$$

$C_{k,m}$=a coefficient at iteration i;

$R_{p,m}$=the DFT of $r_p(nT)$ at harmonic m where $$r_p(nT)$$

=the total signal observed at sensor p.

6. Repetitive phenomena cancelling controller arrangement as claimed in claim 1, wherein said known frequency determining means samples the unwanted repetitive phenomena synchronously or asynchronously and the cancelling phenomena signals are generated in accordance with the algorithm $$C_{k,m}(n+1) = C_{k,m}(n) - a \sum_{p=1}^{Ns} H^*_{pk}(m) \exp(-jmwonT)\, r_p(nT)$$

and $$c_k(tjm) = x_{k,m}(i) \cos mw_o t - y_{k,m}(i) \sin mw_o t$$

and $$c_k(t;m) = x_{k,m}(i) \cos mw_o t - y_{k,m}(i) \sin mw_o t$$

for k=1, . . . , Na, Na=number of actuators m=1, . . . , Nh, Nh=number of significant harmonics a=small positive constant Ns=number of sensors $H^*_{pk}(m)$=the complex conjugate of a transfer function from an actuator K to a sensor p at frequency $mw_{o1}$ where wo is a fundamental frequency $r_p(nT)$=total signal observed at sensor p $C_{k,m}(i) = X_{k,m}(i) + iy_{k,m}(i)$ a coefficient at iteration i.

* * * * *

UNITED STATES PATENT AND TRADEMARK OFFICE

CERTIFICATE OF CORRECTION

PATENT NO. : 5,091,953

DATED : February 25, 1992

INVENTOR(S) : Steven A. Tretter

It is certified that error appears in the above-indentified patent and that said Letters Patent is hereby corrected as shown below:

Col. 19, Claim 5, lines 2 and 3, delete "known frequency determining" and insert --controller--.

Col. 20, Claim 6, lines 2 and 3, delete "known frequency determining" and insert --controller--.

Signed and Sealed this

Twenty-fourth Day of May, 1994

Bruce Lehman

*Attest:*

BRUCE LEHMAN

*Attesting Officer*

*Commissioner of Patents and Trademarks*